United States Patent [19]

Silk et al.

[11] Patent Number: 4,940,620

[45] Date of Patent: Jul. 10, 1990

[54] HIGHCHAIR FOOD COLLECTION

[76] Inventors: Vicki A. Silk, P.O. Box 18021, San Jose, Calif. 95158; Regina Gray, 1245 Mountain Quail Circle, San Jose, Calif. 95120

[21] Appl. No.: 425,602

[22] Filed: Oct. 23, 1989

[51] Int. Cl.[5] ..... B32B 3/02; B32B 3/10

[52] U.S. Cl. ..... 428/81; 428/138; 5/417

[58] Field of Search ..... 428/61, 77, 81, 131, 428/138; 5/417, 420

[56] References Cited

U.S. PATENT DOCUMENTS 2,525,450 7/1950 Hull .
2,853,399 9/1958 Shoults .
3,323,151 6/1967 Lerman ..... 5/420
4,370,767 2/1983 Fraser .
4,574,101 3/1986 Tricca et al. ..... 5/420

*Primary Examiner*—Alexander S. Thomas

[57] ABSTRACT

A mat structure adapted for placement on a kitchen floor underneath an infant's highchair to intercept food particles or liquids that would otherwise fall onto the floor during an infant feeding operation. The mat structure includes two rectangular panels that are hingedly connected together. Handles on outer edges of the panels enable the mother to carry the mat structure over to the sink where the panels can be set upright (on edge) on the sink counter surface; food particles can be wiped from the panel surfaces directly into the sink. The panels can be folded flat against one another to put the mat structure into a compact storage mode.

4 Claims, 1 Drawing Sheet

HIGHCHAIR FOOD COLLECTION

BACKGROUND AND SUMMARY OF THE INVENTION

Mothers often place their infant children in high chairs when feeding them baby food or liquids. Some of the food or liquid falls onto the high chair or onto the floor, due for example to the baby hitting the spoon that the mother is using for feeding purposes.

The present invention relates to a mat structure that can be placed on the kitchen floor beneath the infant's highchair to catch (intercept) foods and liquids. The pad structure has a plan dimension larger than the plan dimension of the highchair, such that the mat structure extends laterally beyond the sides and front of the chair; food thrown or otherwise discharged beyond the chair confines will be caught by the mat structure without impinging against the floor surface. After the feeding operation food particles or liquids adhering to the infant or high chair can be swept or wiped so as to fall onto the pad structure surface.

The pad structure is formed by two self-sustaining rigid panels that are hingedly connected together along their adjoining edges. The mat structure can be placed in a partially folded upright condition on a kitchen sink, with the two panels having lateral edges thereof resting on the sink surface; the panels will then have a V-configuration in the top plan view, so that any food particles or liquid accumulations can be wiped from the panel surfaces into the sink. The pad structure is designed to be without cracks or crevices that could catch or trap food particles during the wiping operation.

The hinge connection between the two panels permits the panels to be folded flat against one another, to thus reduce the overall size of the mat structure when it is desired to store the mat structure, e.g. between the refrigerator and kitchen wall, or in a cupboard.

THE DRAWINGS

DESCRIPTION OF A PREFERRED EMBODIMENT OF THE INVENTION

Figure 1:
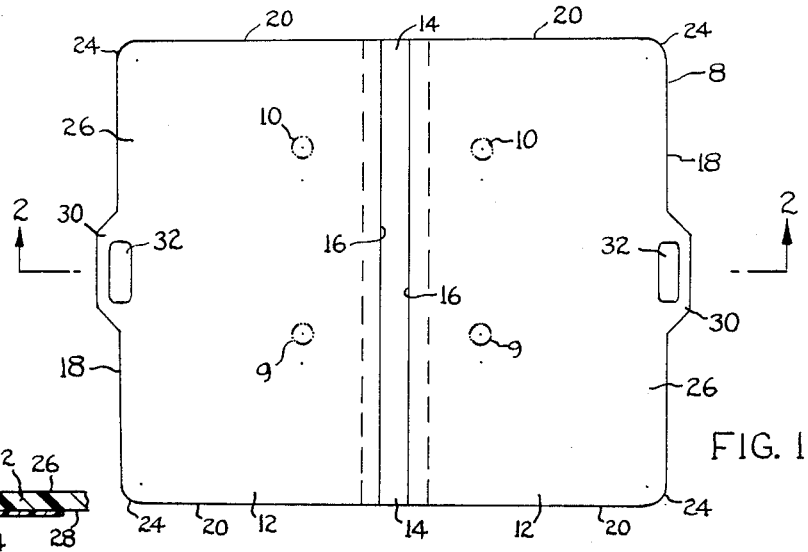
FIG. 1 is a top plan view of a mat structure constructed according to the invention.

FIG. 1 shows a foldable mat structure 8 adapted for placement on a floor surface underneath an infant's high chair. The four legs of the high chair are designated by numerals 9 and 10.

Numeral 9 designates the front legs, while numeral 10 designates the rear legs. The high chair will normally be positioned at a central point on the mat structure, such that food particles inadvertently discharged into the atmosphere during an infant feeding operation will fall onto the mat upper surface, rather than onto the floor surface.

Mat structure 8 comprises two similarly dimensioned rectangular panels 12 arranged in side-by-side relation.

The panels are hingedly connected together by means of a relatively thin flexible strip of material 14 extending along adjacent edge areas of the panels.

Each panel 12 has two longitudinal edges 16 and 18, and two interconnecting lateral (transverse) edges 20. Outer corner areas of the panels may be rounded, as at 24, to avoid possible injury to a person should the corner strike the person's arm or other area of the body.

Each panel 12 is preferably formed of a rigid transparent plastic material, such as plexiglass or polystyrene. The panel thickness is preferably in the range of between one eight inch and one quarter inch. The primary criteria in selecting the panel thickness is to make each panel self-sustaining, so that it does not bend significantly or form creases in its surface when the pad structure is lifted or oriented in a vertical position overlying the kitchen sink.

During a baby feeding operation food particles and liquid will (or may) fall onto the upper face 26 of each panel 12; some particles may also fall onto the upper face of hinge strip 14. After the feeding operation any particles on the baby or on the high chair will be brushed off so as to fall onto pad structure surfaces 26. After removal of the high chair from pad structure 8 the pad structure can be lifted from the floor surface and carried over to the kitchen sink (or possibly to a garbage container). The pad structure can be set upright on the sink with panels 12 extending vertically and partially folded into a V-configuration (viewed in the top plan direction). Any food particles or liquids on panel surfaces 26 can be wiped directly into the sink.

The transparent nature of panels 12 is helpful during the wiping (cleaning) operation. The mother can look through each panel to see where the particles are located, and to see when the panel is cleaned (akin to viewing a window to locate and remove dirt particles thereon).

Figure 3:
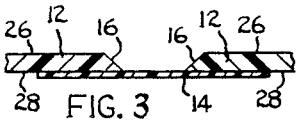
FIG. 3 is a fragmentary enlarged view taken in the same direction as FIG. 2, and showing structural details not visible in FIG. 2.

The upper surfaces of panels 12 and hinge strip 14 are smooth and non-porous; also, the panel longitudinal edges 16 are beveled along the panel upper face, as shown in FIG. 3, to provide a relatively smooth non-abrupt joint between the flexible strip 14 and the panel upper surfaces The smoothness of the joint is advantageous during the operation of sweeping food particles or liquid into the sink (or garbage container); particles are less likely to remain adhered to the pad structure (within cracks or crevices).

Each panel 12 has a preferred length ranging between about thirty inches and thirty six inches, and a preferred width (parallel to edges 20) ranging between about sixteen inches and twenty two inches. Hinge strip 14 is facially attached to the lower faces 28 of panels 12. This is advantageous in that when the hinge strip is in its folded condition (FIG. 4) the hinge strip will have a relatively large radius of curvature, thereby minimizing the possibility of cracks or creases forming in the strip material after repeated periods of service.

Figure 4:
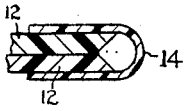
FIG. 4 is a view similar to FIG. 3 but showing the structure in a folded condition.
Figure 2:
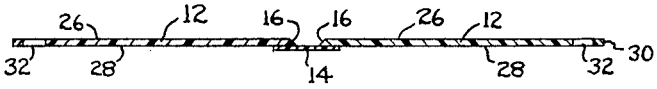
FIG. 2 is a sectional view taken on line 2—2 in FIG. 1.

As shown in FIG. 4, panels 12 can be folded flat so that the normally upper surfaces 26 of the panels lie flat against one another. FIG. 4 shows the pad structure in its folded storage mode, better adapted for storage in a cupboard or vertically between a refrigerator and kitchen wall. In its folded condition the mat structure has only about one half the area that it has when unfolded to the FIG. 1 condition.

The two panels 12 are provided with two similarly dimensioned handles 30 located midway along the two outer longitudinal edges 18 of the panels. Each handle is an integral extension of the associated panel; i.e. it is formed by an elongated hole 32 in the panel material. Each handle has the same thickness as the associated panel so that the panels can be folded flat against one another (for storage) without interference from the handles. Handles 30 are useful primarily for carrying the pad structure to the kitchen sink for cleaning purposes. The pad upper surfaces are flat, but food particles and liquids will tend to remain thereon if handles 30 are grasped in such a way that the panels remain essentially horizontal, at least until the person reaches the sink (or garbage container).

Figure 5:
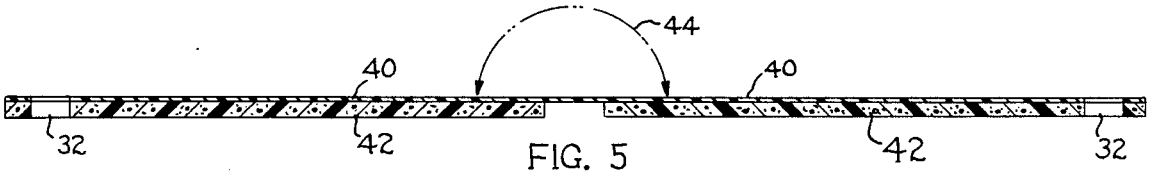
FIG. 5 is a sectional view taken in the same direction as FIG. 1, but illustrating a second form that the invention can take.

FIG. 5 shows a second form that the invention can take. In this case, the pad structure is formed by a single thin flexible sheet of material 40 facially adhered to two generally rectangular panels 42 that are spaced slightly apart. Panels 42 are formed of a rigid foam material that contributes rigidity to the pad structure without adding any appreciable weight or cost. Sheet 30 is a relatively thin flexible material (thick film) having a smooth exposed upper surface adapted to be easily cleaned of accumulated solids or liquids.

Panels 42 have their adjacent edges unconnected and spaced apart, such that the intervening central area of flexible sheet 40 can act as a hinge to permit the two panel sections to be folded onto one another, as indicated by imaginary line 44 in FIG. 5. Holes 32 are formed through the panels and sheet 40 to form handles.

FIG. 5 represents one possible form that the invention could take. A preferred form of the invention is shown in FIGS. 1 through 4.

I claim:

1. A foldable mat adapted for placement on a floor underneath an infant's highchair to catch food items; said mat comprising two similarly dimensioned rectangular panels;

each panel having a flat uninterrupted upper face, a flat uninterrupted lower face, two longitudinal side edges, and two connecting lateral edges; said panels being arranged in side-by-side relation, with two of their longitudinal edges spaced a slight distance apart;

Means hingedly connecting said panels together for folding motion around an axis extending midway between said two longitudinal edges, so that the upper faces of the panels lie flat against one another in a storage mode; said hinge means comprising a continuous flexible strip of material extending the full length of the associated panels;

the upper face of each panel being a smooth non-porous surface devoid of crevices that could retain food or liquid when the surface is wiped with a damp cloth;

and similarly dimensioned handles located midway along the other two longitudinal edges of the panels; each handle being an integral extension of the associated panel; each handle having the same thickness as the associated panel, whereby the panels can be folded flat against one another without interference from the handles;

each panel being a rigid self-sustaining structure, whereby the defined mat can be placed upright on a kitchen sink with the two panels having lateral edges thereof resting on the sink surface so that the pad has a V-configuration in the top plan view, said panels being sufficiently rigid so that food and liquids can be wiped from the normally upper faces of the panels into the sink.

2. The foldable mat of claim 1, wherein said continuous flexible strip is facially engaged with the lower faces of the panels; each of said two longitudinal panel edges being beveled along the panel upper face to provide a smooth non-abrupt joint between the flexible strip and each panel upper surface.

3. The foldable mat of claim 1, wherein each panel is formed of a transparent plastic material having a thickness ranging between one eight inch and on quarter inch.

4. The foldable mat of claim 1, wherein each panel has a length ranging between thirty inches and thirty six inches, and a lateral width ranging between sixteen inches and twenty two inches.

* * * * *